United States Patent [19]

Villalobos

[11] Patent Number: 4,768,232

[45] Date of Patent: Sep. 6, 1988

[54] COMBINED CAP AND BASEBALL MITT

[76] Inventor: Richard Villalobos, 7528 Woodlake Ave., Canoga Park, Calif. 91304

[21] Appl. No.: 540,401

[22] Filed: Oct. 11, 1983

[51] Int. Cl.[4] ..... A41D 13/10; A41D 19/00

[52] U.S. Cl. ..... 2/19; 2/161 A; 2/195; 2/196

[58] Field of Search ..... 2/196, 199, 195, 19, 2/158, 209.1, 250, 161 A

[56] References Cited

U.S. PATENT DOCUMENTS

| | | | |
|---|---|---|---|
| 133,689 | 12/1872 | Whitaker | 2/158 |
| 373,048 | 11/1887 | Burr | 2/158 |
| 1,161,637 | 11/1915 | Dunn | 2/199 |
| 1,496,330 | 6/1924 | Tollefson | 2/250 |
| 1,664,255 | 3/1928 | Lesser | 2/199 |
| 1,810,655 | 6/1931 | Hosking | 2/199 X |
| 1,869,652 | 8/1932 | Baker | 2/199 X |
| 1,974,616 | 9/1934 | Kirkham | 2/19 |
| 2,420,569 | 5/1947 | Sewell | 2/195 |
| 2,434,170 | 1/1948 | Latina | 2/19 |
| 2,615,168 | 10/1952 | Tannenbaum | 2/196 |
| 2,688,204 | 9/1954 | Laubhan | 2/209.1 |
| 2,710,973 | 6/1955 | Feldman | 2/199 |
| 2,744,256 | 5/1956 | Slotkin et al. | 2/195 |
| 2,794,189 | 6/1957 | Nesbit et al. | 2/195 |
| 3,085,252 | 4/1963 | Smith | 2/195 |
| 4,165,542 | 8/1979 | McLaughlin | 2/209.1 |
| 4,312,076 | 1/1982 | Gamm | 2/199 |
| 4,386,437 | 6/1983 | Fosher | 2/199 |
| 4,451,935 | 6/1984 | Henschel | 2/195 X |
| 4,472,837 | 9/1984 | Saxton | 2/195 X |
| 4,628,543 | 12/1986 | Hunt | 2/19 |

*Primary Examiner*—Louis K. Rimrodt

*Attorney, Agent, or Firm*—Don B. Finkelstein

[57] ABSTRACT

A combination baseball cap and baseball glove forming an object-catching head covering. A mitt is attached to the crown of the cap preferably above the brim. The mitt can be in the shape of a rectangle, mitten or glove and fabricated from the same material used in making the cap, or from elastic material. An opening along the edge of the mitt is provided above the brim. The opening and the mitt are sized to allow the user to insert one hand into the opening to be held between the mitt and the crown. An elastic band may be attached to the mitt along the edge of the opening to aid in holding the cap in place on the hand. A logo can be place on the outside of the mitt. Padding may be used to further protect the user's hand while catching objects. The padding can be a flat sheet of energy absorbing material or may be shaped to approximate the function of a baseball glove.

22 Claims, 2 Drawing Sheets

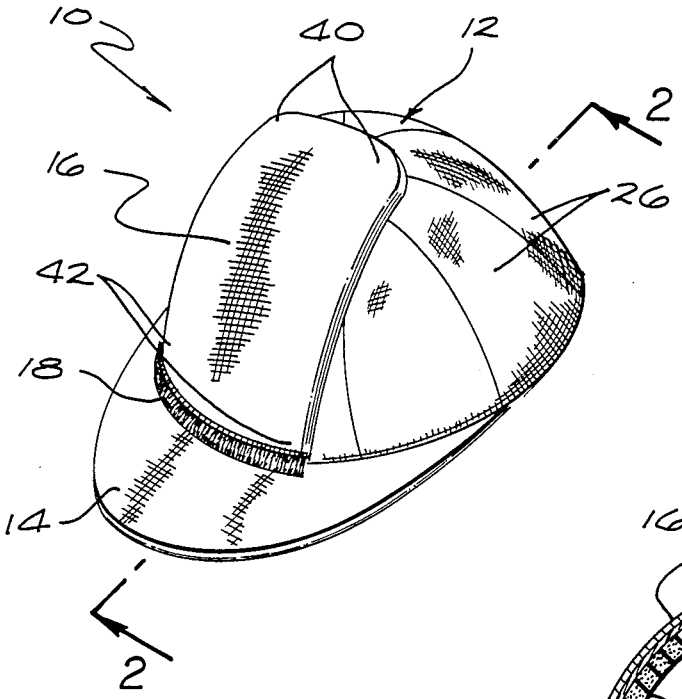
FIG. 1
FIG. 2
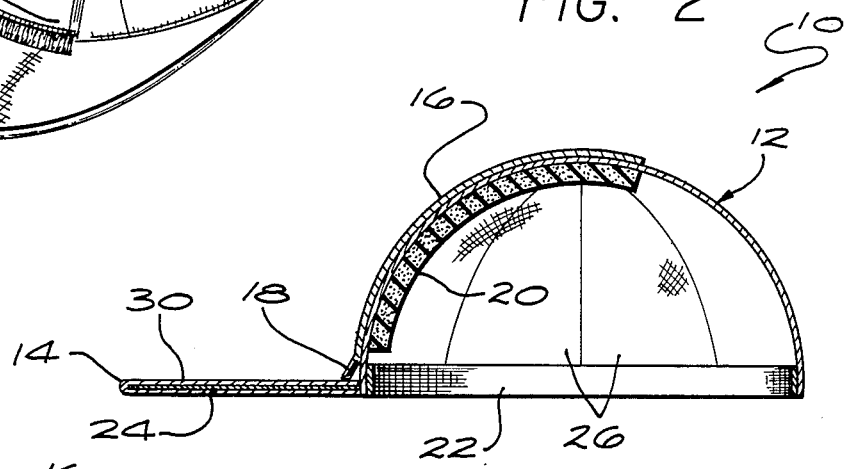
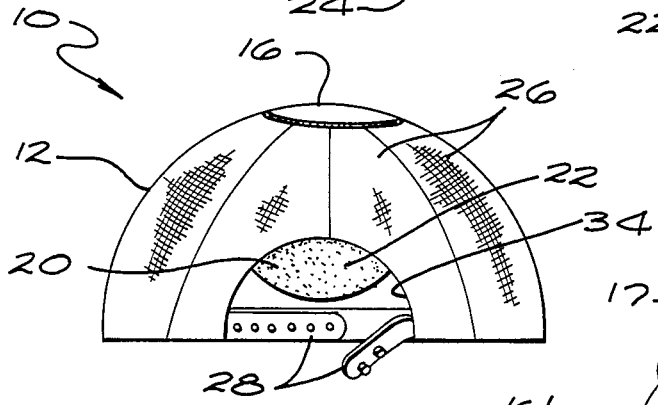
FIG. 3
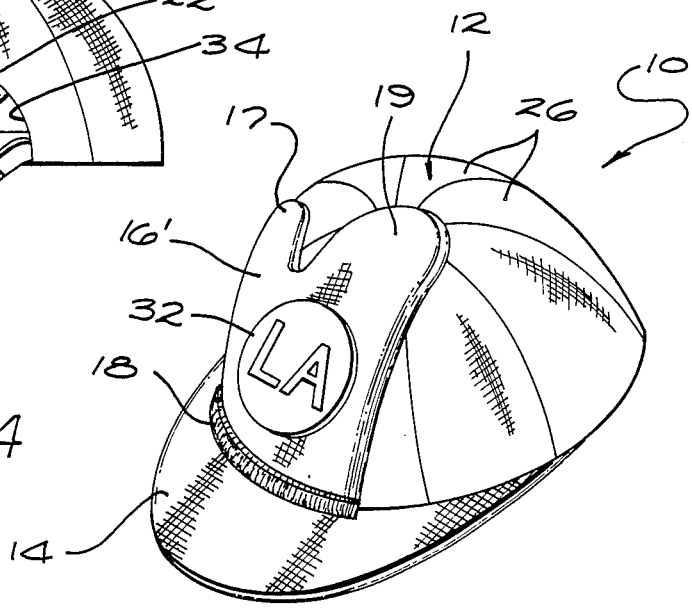
FIG. 4

COMBINED CAP AND BASEBALL MITT

BACKGROUND OF THE INVENTION

1. Field of the Invention

This invention relates to the head covering art, and more particularly, to a combination head covering and hand covering to assist the user in catching objects and further to protect the hand by providing padding.

2. Description of the Prior Art

The history of head covering is long and colorful. Many sizes, shapes and colors have appeared from time to time for the purposes of protection, decoration, and simply style. Currently, one of the more popular head coverings is the baseball cap.

A baseball cap usually consists of four to six basicly triangular shaped sections sewn together so that the apex of each triangle meets in the center. The triangles are slightly tapered so that the completed assembly forms a concave crown sized to fit on top of the head. A stiff brim in the form of a visor that can shade the eyes is sewn to a portion of the crown. The shape of the visor, the size of the crown, the material comprising each, variations in the structures forming the cap, and additional items of decoration or identification added to the cap are all well known in the art. Such baseball caps are often worn by spectators at baseball games. The caps are worn on the head and thus are stored and yet mobil with the spectator.

In addition to baseball caps, baseball gloves are well known to baseball afficionados. Baseball gloves come in primarily a round shape for a catcher's glove and essentially square shaped for fielder's gloves, each glove having its particular specialization for the particular player's position and preference. The padding for each of these gloves varies, depending upon the exposure to injury commensurate with performing the desired function of catching a ball. For example, the catcher's glove is heavily padded to sustain the impact of the high velocity baseball delivered by the pitcher. The fielders' gloves require less padding and thus provide more control surface to hold the ball in the glove yet allow the ball to be easily removed from the glove. Some gloves, as a first baseman's glove, are particularly specialized for trapping the ball by providing a large web between the thumb and fingers with a "U" shaped pad protecting the thumb, the heel of the hand, and the fingers.

Baseball gloves of any style are often carried by a spectator to a baseball game in hopes the glove will aid in the fielding of a fly ball, that perchance should fall within the spectator's vicinity. It is possible that the spectator may be injured of he tries to "bare hand" the ball. The above described baseball gloves are comparitively large, cumbersome, and can become a bother and present problems. Once a spectator arrives at a seat in the stands there is no place to conveniently store the glove. If the glove is placed on the ground, the glove tends to be kicked around and becomes difficult to locate on a moment's notice when a fly ball is hit into his vicinity. Further, the glove can be forgotten at the end of the game.

Thus, there has long been a need to combine the convenience of a baseball cap with the protection of a baseball glove. The concave shape of the crown makes the baseball cap an attractive candidate to form an object-catching device. Many people try to use a baseball cap, as presently constructed, as an object-catching device by grasping the cap by the brim and holding the crown out as a net to catch the ball. The ball will usually spill out over the edge of the cap into the hands of another. Thus, it is desired to provide some method to affix the concave surface of the baseball cap crown to the user's hand. Such an attachment means will allow quick final adjustments in positioning the cap to catch the ball without losing a grip on the cap or crushing the crown before the ball enters the cap. Further, once the ball is in the crown of the cap, the hand can close around the ball preventing the ball from spilling out.

It is further desired that the catching device be readily available and easily implemented during those few moments between realization that a ball is coming near the user's vicinity and that precious moment of capture of the ball as one's own.

There have heretofore been devised various structures which, combined with caps, can perform various functions. For example, U.S. Pat. Nos. 2,597,447 and 2,668,204 showing a combined cap and fishnet; U.S. Pat. Nos. 1,361,289, 2,828,487, and 4,165,542 show various arrangements of combined caps and bags or pouches for carrying the cap; 2,443,848 shows a cap and rain collector; and 4,080,665 shows a combined cap and tennis racket cover.

None of these prior art arrangements can provide a convenient and easily useable combined cap and glove for catching, for example, a baseball. Thus, there has long been a need for structural arrangements combining the functions of a cap and a baseball glove.

SUMMARY OF THE INVENTION

Accordingly, it is an object of the present invention to provide an improved combination of head covering and object catching aid.

It is another object of the present inventicn to provide a catching aid that is easily accessible and can be quickly implemented.

It is yet another object of the present invention to provide a catching aid that protects the hand of the user while catching an object such as a hard ball used in baseball.

It is yet another object of the present invention to provide a catching device that can be used as a head covering so that the catching device is easily storable on the person, therefore mobile with the person, and not subject to being lost in the spectator stands or forgotten during the joy of celebration or agony of defeat after the game.

The above and other objects of the present invention are achieved according to the preferred embodiment thereof, by providing a flexible crown of a baseball cap to which is affixed a brim and a flexible mitt. The mitt can be positoned anywhere on the crown but is most conviently located above the brim.

The crown is fabricated from flexible sheet material and can be composed of a wide variety of fabrics. Some fabrics currently used are simple cotton, blends of cotton and synthetic materials, all synthetic material, and plastic. The finish of the material may be smooth, textured, or velvety. The colors can coincide with the colors of a particular logo attached to the cap or can be selected for other reasons such as safety. The selected material is preferrably light weight and can be composed of a solid, closely woven material alternating with an open weave, screen-like material for ventilatilation. The crown may be comprised of four to six triangular shaped sections that taper outward and then inward slightly from the apex to the base so that when the triangles are sewn together with the apexes meeting in the center, the crown will form a concave shape that will cover the tcp of the head. One or more of the sections may have a cut out at the base of the triangle to allow the attachment of an adjustable band to provide a one-size-fits-all configuration.

The shape and dimensions of the brim are limited only by acceptable proportions to the crown and other considerations such as weight and visability. The brim may be stiff or slightly flexible depending upon the type and thickness of the sheet material used as the stiffener for the brim. The stiffener of the brim may be covered in the same fabric constituting the crown.

The mitt affixed to the outside surface of the crown may be constructed in many shapes. A universal shape would preferrably be slightly rectangular so that either right or left hand may be inserted. Other shapes such as a mitten or glove or any combination thereof may be used but would, of course, be shaped for either the right or the left hand. The mitt must have an opening so that a hand can be inserted between the mitt and the outside surface of the crown. The preferred location for the opening is directly over the brim because the brim serves as a reference point for finding the opening. The edge of the mitt forming the opening may also include an elastic band which helps hold the head covering in place after the hand has been inserted between the mitt and the crown.

The mitt may fabricated of flexible sheet material which additionally is elastic so that it will conform to the shape of the crown yet allow the insertion of the hand without use of great force resulting in possible deformation or damage to the mitt and crown. A logo for a particular baseball team, geographic area or other entity may be added to the cap for decoration. The usual placement for the logo is on the crown above the brim, which is also the preferred location for the mitt. Therefore, consideration should be given to the size of the logo so that the logo does not impede the flexibility and elasticity of the mitt.

The catching device may further include padding to provide protection for the user's hand. This padding may be secured to the inside surface of the crown in an area substantially coextensive with the mitt, and may be fabricated from high impact material such as foam rubber or light padding such as spun dacron fiber filling, cotton bunting and the like. Alternatively, the padding may be secured to the outside surface of the crown. The padding may be shaped as a uniform sheet or may be shaped to resemble the selected style of baseball glove. The padding may be doughnut shaped to resemble a catcher's mitt, or U shaped to resemble a fielder's glove. To avoid possible injury, the normal button that is sometimes affixed at the apex of the crown is preferrably eliminated from the catching aid in some embodiments thereof.

The padding is chosen to provide maximum protection, yet minimum interference with the head covering function of the cap. The cap should fit on the head without bulging or introducing bumps into normally accepted cap appearance.

BRIEF DESCRIPTION OF THE DRAWINGS

The above and other embodiments of the present invention may be more fully understood from the following detailed description, taken together with the accompanying drawings, wherein similar referenced characters refer to similar elements throughout, and in which:

FIG. 1 is a perspective view of the object-catching head covering showing the position of the mitt on that portion of the crown adjacent the region in which the crown is attached to the brim;

FIG. 2 is a cross section view of the cap illustrating the padding attacned to the crown;

FIG. 3 is a perspective view of the head covering showing the adjustable band means;

FIG. 4 is a perspective view of the object-catching head covering showing the mitt in the shape of a mitten with a logo attached to the mitt;

DESCRIPTION OF THE PREFERRED EMBODIMENT

Figure 5:
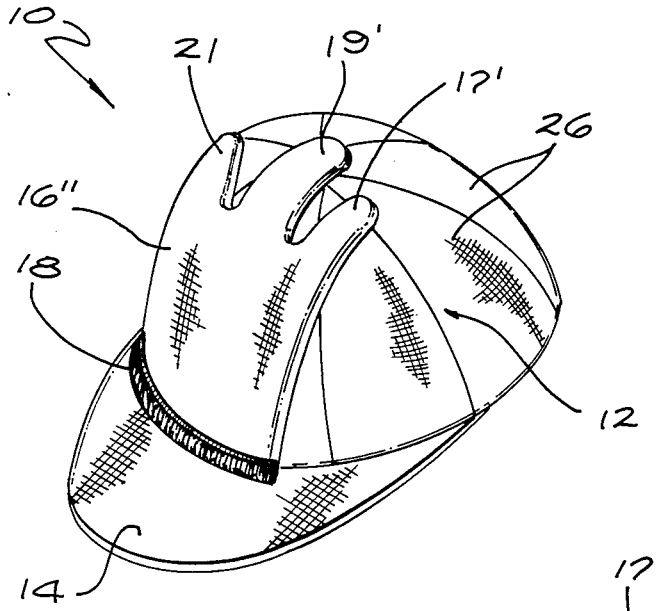
FIG. 5 is a perspective view of the object-catching head covering showing the mitt in the shape of a mitten with two recepticals for a plurality of fingers.

Referring now to the drawing, there is illustrated in FIG. 1 a perspective view of the object-catching head covering 10. As depicted, the head covering 10 consists of a baseball cap consisting of a crown 12 with a brim 14 and a mitt 16 attached to the crown 12. This combination will assist the user in catching objects such as baseballs and will help avoid possible injury to a spectator who tries to "bare hand" the ball. The crown 12, in this embodiment, consists of a plurality of essentially triangular sections 26. In the preferred embodiment shown in FIG. 1, si triangular sections 26 are sewn together with the apex of each triangular section touching in the center of crown 12. The triangular sections taper outward and then inward slightly from the apex to the base so that when the triangular sections 26 are completely attached to each other they form the concave crown 12 which is of the size and shape that may be conveniently fitted on top of a head.

The triangular sections 26 may be cut from flexible sheet material such as cotton, cotton and synthetic blend, 100% synthetic, or the like. The triangular sections 26 may be all of the same material, or of alternating types of material. One configuration uses solid, tightly woven material for one triangular section 26 alternating with an open guage material that provides a degree of ventilation to the cap. The periphery of the crown 12 may be finished with a lined portion 22. A portion of one or more of the sections may be shaped to produce a cutout defined by first walls 34 along the periphery of crown 12 as shown in FIG. 3 and replaced by an adjustable band means 28 allowing the cap to be manufactured in a one-size-fits-all configuration.

FIG. 1 shows the placement of the brim 14 or a selected portion of the periphery of the crown 12, preferably opposite the cutout defined by first walls 34. The brim 14 and crown 12 are attached in a manner to allow the brim to curve slightly when the cap is put on and still retain a stiffness to protrude outwardly from the head rather than fold down around the head. FIG. 2 shows the construction of the brim 14 to be a skeleton stiffener 24 covered with fabric. The brim covering 30 fabric may be selected to be the same fabric used in constructing the triangular sections 26 to give a unified appearance to the head covering 10. Other fabricatior technique may be employed for the brim 14 (as well as the crown 12) such as forming the brim 14 from a molded plastic shape. The particular type of fabrication may be chosen to meet the particular economics and style consciousness of the user.

The mitt 16 is coupled to the outside surface of the crown 12 and is fabricated of flexible sheet material. This flexible sheet material may be selected to be the same type of material used in fabrication of the crown 12. If such material is selected, an extra fold, dart or edging around the mitt 16 may be provided to allow the insertion of the hand between the mitt 16 and the crown 12. Alternatively, the mitt 16 may be sized so that the edges of the mitt 16 deform when the hand is placed between the mitt and the crown 12. Care must be taken so that the concave shape of the crown 12 is not greatly deformed upon insertion of the hand as deformation may interfere with the catching function of the head covering 10.

In other embodiments the mitt 16 is fabricated from elastic material or a stretch material such as that used in creating stockings and stocking caps. The use of this elastic material allows the hand to be inserted between the mitt 16 and the crown 12 with minimal deformation of the crown. If elastic material is chosen for the mitt 16, consideration must be given to the size, shape and material comprising the logo 32 shown in FIG. 4 to be sewn onto the mitt 16. The logo 32 should not be of a size sufficient to interfere with the elastic properties of the mitt 16.

The elastic quality of the mitt 16 should be selected to allow the hand to be placed between the mitt 16 and the outside surface of the crown 12 without restriction. For increased attachment capability of the head covering 10 to the hand, a band 18 of elastic material can be added to the edge of the mitt 16 along the opening allowing access for the hand to be inserted in between the mitt 16 and the crown 12. The size and shape of the band 18 should be selected to allow easy insertion of the hand, but once the hand is inserted to firmly hold the head covering 10 in place.

The mitt 16 may be shaped many different ways. FIG. 1 shows the mitt 16 to be generally rectangular with two rounded corners 40 on the edge nearest the top of the crown 12 and two square corners 42 near brim 14. The mitt 16 is attached to the crown 12 along the periphery of the mitt 16 except for that portion of the periphery between the square corners 42. This is a universal mitt 16 allowing either the right or the left hand to be inserted into the opening between the square corners 42 in accordance with the user's preference. The opening between the square corners 42 is placed over the brim 14 so that the opening can be easily located by the user.

FIG. 4 shows a more specialized shape of a mitt 16' forming a receptable 17 for the thumb and a separate receptacle 19 for the remaining fingers.

FIG. 5 shows a modified mitt 16'' formed for a left handed user having a receptacle 17' for the thumb, a second receptacle 19' for a plurality of fingers, and a third receptacle 21 for the remaining fingers of the user.

Figure 6:
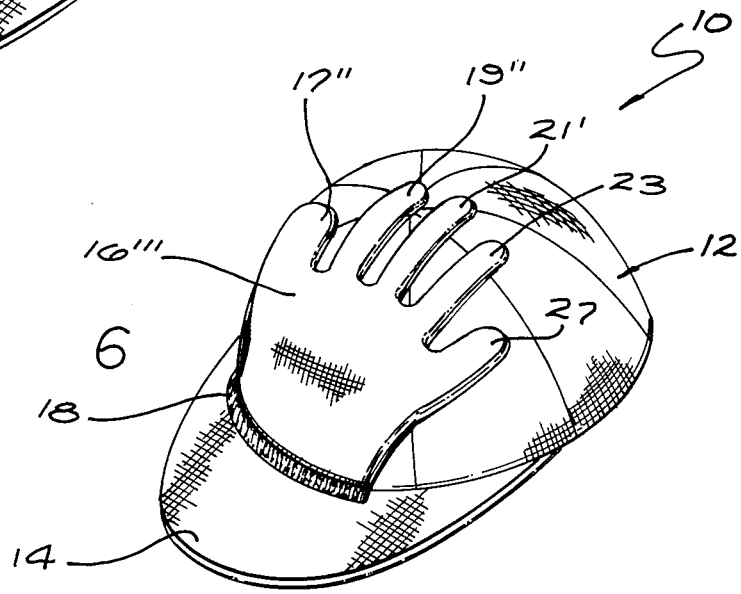
FIG. 6 is a perspective view of the object-catching head covering showing the mitt in the shape of a five fingered glove.

FIG. 6 shows individual receptacles 17'', 19'', 21', 23 and 27 for each of the four fingers and the thumb forming a mitt 16 in the shape of a glove for right hand applications.

To further minimize possible injury to the spectator, a pad 20 to protect the user's hand may be attached to the crown in an area substantially coextensive with the mitt 16. The pad can be secured to the inside or outside surface of the crown 12. FIG. 2 shows a pad 20 as a sheet of uniform thickness attached to the inside of the crown.

Figure 7:
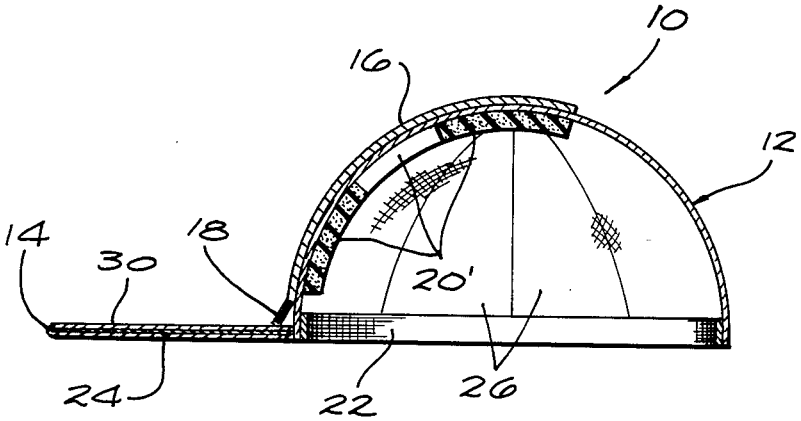
FIG. 7 is a cross section view of the cap illustrating the doughnut shaped padding attached to the crown.

The pad may be shaped to resemble a selected style of baseball glove. FIG. 7 shows the cross section of a doughnut shaped pad 20' affixed to the inside of the crown 12. The size of the doughnut pad 20' is selected to provide padded protection to the thumb, heel of the hand, little finger and first joints of the remaining fingers of the user. When the doughnut shaped pad is used with the mitten shaped mitts 16' as depicted in FIG. 4, a portion of the doughnut may be omitted between the first receptacle 17 for the thumb and the second receptacle 19 for the rest of the users fingers.

The pad 20 may be U-shaped as in a fielder's glove to provide protection to the thumb, heel of the hand and a plurality of fingers remote from the thumb. This U-shaped pad is particularly adapted for use with mitts depicted in FIGS. 5 and 6.

The pad 20 may be fabricated from high impact material such as foam rubber of the like. Light padding may be provided by using material such as spun dacron fiber filling, cotton bunting and the like to form the pad 20. The choice of padding is determined by the amount of protection desired for the user's hand. However, the choice of the amount of protection should also consider the fit of the crown 12 on the user's head. The head covering 10 should fit without bulging or introducing bumps into normally accepted cap appearance.

This concludes the description of a preferred embodiment of the present invention. Those skilled in the art may find many variations and adaptions falling within the scope of this invention, and the appended claims are intended to cover all such variations and adaptions falling within the true scope and spirit of this invention.

What is claimed is:

1. An object-catching head covering comprising:

a concave crown formed of a flexible sheet material;

a brim comprising a stiffener with a flexible sheet material covering over the stiffener, the brim secured to a preselected portion of the periphery of said crown; and a mitt formed of flexible sheet material mounted on said crown and attached along a preselected portion of the periphery of said mitt to said crown, said mitt having an opening along the periphery of said mitt, said mitt and said peripheral opening being dimensional so that the user of said head covering can insert one hand between said mitt and said crown whereby the crown can be positioned by the user as a hand protector and aid for catching objects.

2. An object-catching head covering defined in claim 1 which further comprises:

first walls forming a cutout starting on the peripheral edge of said crown, proceeding a preselected distance toward the center of said crown and returning to the peripheral edge of said crown, said cutout being centered on a portion of the peripheral edge opposite said brim; and adjustable band means attached to first walls near the peripheral edge of said crown whereby the diameter of the peripheral edge of said crown can be adjusted in size to fit the head of the user.

3. An object-catching head covering defined in claim 2 wherein:

said attached portion of said mitt periphery defines a mitten peripheral edge for a preselected hand.

4. An object-catching head covering defined in claim 2 wherein:

said attached portion of said mitt periphery defines a first receptacle for the user's thumb, a second receptable for a plurality of the user's fingers and a third receptacle for the remainder of the user's fingers.

5. An object-catching head covering defined in claim 2 wherein:

said attached portion of said mitt periphery defines a glove shaped peripheral edge having four finger receptacles and a thumb receptacle for a preselected size hand.

6. An object-catching head covering defined in claim 2 which further comprises:

a pad positioned substantially coextensive with said mitt and attached to said crown whereby said pad further protects the user's hand.

7. An object-catching head covering defined in claim 6 wherein:

said pad is doughnut shaped of a size to provide protection to the thumb, heel of the hand, little finger and the first joints of the remaining fingers of the user.

8. An object-catching head covering as defined in claim 6 wherein:

said pad is U shaped of a size to provide protection to the thumb, heel of the hand and a plurality of fingers remote from the thumb of the user.

9. An object-catching head covering as defined in claim 2 wherein:

said mitt is positioned on the outside of said crown.

10. An object-catching head covering as defined in claim 9 wherein:

said opening along the periphery of said mitt is substantially coextensive with said preselected portion of the periphery of said crown to which said brim is attached.

11. An object-catching head covering as defined in claim 10 which further comprises:

elastic band means attached to said mitt periphery and substantially coextensive with said opening along said periphery.

12. An object-catching head covering as defined in claim 11 which further comprises:

a logo attached to the outside of said mitt.

13. An object-catching head covering comprising:

a concave crown formed of a flexible sheet material;

a brim comprising a stiffener with a flexible sheet material covering over the stffener, the brim secured to a preselected portion of the periphery of said crown; and a mitt formed of elastic, sheet material mounted on said crown and attached along a preselected portion of the periphery of said mitt to said crown, said mitt having an opening along the periphery of said mitt, said mitt and said peripheral opening being dimensional so that the user of said head covering can insert one hand between said mitt and said crown whereby the crown can be positioned by the user as a hand protector and aid for catching objects.

14. An object-catching head covering defined in claim 13 which further comprises:

first walls forming a cutout starting on the peripheral edge of said crown, proceeding a preselected distance toward the center of said crown and returning to the peripheral edge of said crown, said cutout being centered on a portion of the peripheral edge opposite said brim; and adjustable band means attached to first walls near the peripheral edge of said crown whereby the diameter of the peripheral edge of said crown can be adjusted in size to fit the head of the user.

15. An object-catching head covering defined in claim 14 wherein:

said attached portion of said mitt periphery defines a first receptacle for the user's thumb, a second receptacle for a plurality of the user's fingers and a third receptacle for the remainder of the user's fingers.

16. An object-catching head covering defined in claim 14 which further comprises:

a pad positioned substantially coextensive with said mitt and attached to said crown whereby said pad further protects the user's hand.

17. An object-catching head covering defined in claim 16 wherein:

said pad is doughnut shaped of a size to procide protection to the thumb, heel of the hand, little finger and the first joints of the remaining fingers of the user.

18. An object-catching head covering as defined in claim 16 wherein:

said pad is U shaped of a size to provide protection to the thumb, heel of the hand and a plurality of fingers remote from the thumb of the user.

19. An object-catching head covering as defined in claim 14 wherein:

said mitt is positioned on the outside of said crown.

20. An object-catching head covering as defined in claim 19 wherein:

said opening along the periphery of said mitt is substantially coextensive with said preselected portion of the periphery of said crown to which said brim is attached.

21. An object-catching head covering as defined in claim 20 which further comprises:

elastic band means attached to said mitt periphery and substantially coextensive with said opening along said periphery.

22. An object-catching head covering as defined in claim 21 which further comprises:

a logo attached to the outside of said mitt.

* * * * *